US010030909B2

(12) United States Patent
Kullertz et al.

(10) Patent No.: US 10,030,909 B2
(45) Date of Patent: Jul. 24, 2018

(54) COOLING SYSTEM FOR ROTARY FURNACES

(71) Applicants: KIMA ECHTZEITSYSTEME GMBH; VEREIN DEUTSCHER ZEMENTWERKE E.V., Dusseldorf (DE)

(72) Inventors: Peter Kullertz, Monchengladbach (DE); Peter Kalkert, Julich (DE); Martin Schneider, Dusseldorf (DE)

(73) Assignee: VEREIN DEUTSCHER ZEMENTWERKE E.V. (DE)

( * ) Notice: Subject to any disclaimer, the term of this patent is extended or adjusted under 35 U.S.C. 154(b) by 67 days.

(21) Appl. No.: 15/311,697

(22) PCT Filed: May 15, 2015

(86) PCT No.: PCT/EP2015/060741

§ 371 (c)(1),
(2) Date: Nov. 16, 2016

(87) PCT Pub. No.: WO2015/177048

PCT Pub. Date: Nov. 26, 2015

(65) Prior Publication Data

US 2017/0097191 A1 Apr. 6, 2017

(30) Foreign Application Priority Data

May 19, 2014 (EP) ..... 14168819

(51) Int. Cl.
*F27B 7/38* (2006.01)
*F27D 9/00* (2006.01)
(Continued)

(52) U.S. Cl.
CPC ..... *F27B 7/38* (2013.01); *F27D 9/00* (2013.01); *F27D 19/00* (2013.01); *F27D 21/0014* (2013.01)

(58) Field of Classification Search
CPC ... F27B 7/38; F27D 9/00; F27D 19/00; F27D 21/004
See application file for complete search history.

(56) References Cited

U.S. PATENT DOCUMENTS 118,674 A * 9/1871 Baynton ..... F27B 7/38 122/6 R
939,817 A * 11/1909 Edison ..... F27B 7/38 422/209

(Continued)

FOREIGN PATENT DOCUMENTS

JP 2001241851 A * 9/2001
WO 01/25494 A1 4/2001

OTHER PUBLICATIONS

International Preliminary Report on Patentability for Application No. PCT/EP2015/060741 dated Nov. 22, 2016.

(Continued)

*Primary Examiner* — Nathaniel Herzfeld
(74) *Attorney, Agent, or Firm* — Tarolli, Sundheim, Covell & Tummino LLP

(57) ABSTRACT

The invention relates to a cooling system (3) for rotary furnaces (1), and also to a method for operating such a cooling system (3). The cooling system (3) comprises for this purpose an arrangement of one or more cooling modules (31, 31', 31"), which are arranged in the portion (21) to be cooled of the furnace shell (2), at least along the axis of rotation (R) of the furnace shell (2), wherein each cooling module (31) comprises an activatable switching valve (311) and a fan nozzle (312) for issuing a pulsed fan-shaped cooling liquid jet (4) and, when there are a number of cooling modules, the neighbouring cooling modules (31, 31', 31") are arranged in relation to one another at a distance (A1) parallel to the axis of rotation (R) of the furnace shell (2). Each cooling module (31, 31', 31") comprises at least one first heat sensor (313), connected to a cooling system control (32), for measuring a first local temperature (T1) of the furnace shell (2) ahead of the area of impingement (41) as seen in the direction of rotation (DR) of the furnace shell (2).

15 Claims, 3 Drawing Sheets

(51) Int. Cl.
*F27D 19/00* (2006.01)
*F27D 21/00* (2006.01)

(56) References Cited

U.S. PATENT DOCUMENTS

| | | | | | |
|---|---|---|---|---|---|
| 4,391,583 | A * | 7/1983 | Serbent | F27B 7/38 | 266/241 |
| 4,973,245 | A | 11/1990 | Monni | | |
| 5,230,617 | A | 7/1993 | Klein | | |
| 6,143,137 | A * | 11/2000 | Gerstenkorn | C10B 39/02 | 165/88 |
| 6,228,143 | B1 * | 5/2001 | Aiken | C22B 7/001 | 266/205 |
| 2016/0123666 | A1 * | 5/2016 | Mizutani | F27B 3/085 | 373/72 |

OTHER PUBLICATIONS

Translation of the International Preliminary Report on Patentability for Application No. PCT/EP2015/060741 dated Nov. 22, 2016.
International Search Report for Application No. PCT/EP2015/060741 dated Aug. 27, 2015.

* cited by examiner

COOLING SYSTEM FOR ROTARY FURNACES

RELATED APPLICATIONS

The present invention is a U.S. National Stage under 35 USC 371 patent application, claiming priority to Serial No. PCT/EP2015/060741, filed on 15 May 2015; which claims priority from EP 141688192.2, filed 19 May 2014, the entirety of both of which are incorporated herein by reference.

FIELD OF THE INVENTION

The invention relates to a cooling system for rotary furnaces, to a rotary furnace having such a cooling system as well as to a method for operating such a cooling system.

BACKGROUND OF THE INVENTION

Rotary furnaces are employed for continuous processes in process engineering. As a rule, a rotary furnace consists of a cylindrical rotary tube that is sometimes many meters or dozens of meters long and that has a furnace shell generally made of metal. In this context, the furnace shell is slightly inclined so that the rotation of the furnace shell causes the material to be transported inside the furnace along the axis of rotation of the furnace shell from the higher inlet side to the lower outlet side. The material that is to be processed can vary and can comprise, for instance, solids, stones, slurries or powders. The requisite processing temperature can be established directly or indirectly in the furnaces. When it comes to materials that call for a high processing temperature, the rotary furnace is heated directly, for example, by means of a lance in the form of a burner situated on the outlet side of the rotary furnace, said lance being located approximately in the middle of the rotary furnace. Directly heated rotary furnaces are used, for example, for cement production, for lime calcining, to melt ceramic glass, to melt down metals, for iron reduction, to produce activated carbon as well as for other applications. In this process, the directly heated rotary furnaces are operated at very high temperatures. During cement production, for example, the raw materials, namely, lime and clay are ground up and calcined in the rotary furnace at approximately 1450° C. to form so-called clinker and subsequently cooled off and further processed after leaving the rotary furnace.

Rotary furnaces that are exposed to such high temperatures have a furnace shell made of stainless steel or of high-temperature steel that can be exposed to temperatures of up to 550° C. or 950° C., respectively. Since the temperatures in the directly heated area are considerably higher, the inside of the furnace shell made of steel is lined with high-temperature ceramic elements. In this context, the thickness of the lining determines the temperature to which the steel shell is exposed during the process. In order to prevent the furnace shell from warping during operation due to the temperature load or in order to prevent damage to the inner lining that would cause the furnace shell to bend or even melt, nowadays the furnace shell is cooled from the outside by means of air fans that are arranged on the outside of the rotary furnace over the entire length of the furnace shell.

Such a cooling technique is complex and takes up a great deal of space around the furnace. Moreover, such a fan cooling system is very noisy and uses a lot of electricity, which is expensive. If the noise pollution of the environment has to be diminished for noise-protection reasons, the rotary furnaces would have to be operated in a soundproofed hall, which would not be advantageous because of the high processing temperatures and which would also be prohibitively expensive due to the cost of the building. Moreover, such a fan cooling system can neither detect nor individually cool strong localized hot spots on the furnace shell.

Before this backdrop, it would be desirable to have a cooling system for rotary furnaces that can be easily and reliably operated at a low noise level, that allows localized cooling control and that reduces the power consumption.

SUMMARY OF THE INVENTION

It is an objective of the present invention to put forward a cooling system for rotary furnaces that can be easily and reliably operated at a low noise level, that allows localized cooling control and that reduces the power consumption.

This objective is achieved by a cooling system for rotary furnaces for cooling at least one section of a furnace shell, comprising an arrangement of one or more cooling modules for applying cooling fluid from the outside onto the furnace shell in an impact area of the cooling fluid on the furnace shell, whereby the cooling modules for the section of the furnace shell that is to be cooled are arranged at a distance from the furnace shell, at least along the axis of rotation of the furnace shell, each cooling module having an actuatable on-off valve and a fan nozzle that emits a pulsed fan-shaped cooling fluid jet and, if there are several cooling modules, the adjacent cooling modules are arranged at a distance relative to each other and parallel to the axis of rotation of the furnace shell in such a way that the impact areas contiguously cool the furnace shell along its axis of rotation, at least in the section that is to be cooled, and whereby each cooling module comprises at least a first heat sensor which is connected to a cooling system control unit and which serves to measure a first local temperature of the furnace shell at a place that is in front of the impact area of the cooling fluid as seen in the direction of rotation of the furnace shell, and which serves to transmit the first local temperature to the cooling system control unit, and the cooling system control unit is configured to actuate the on-off valve of each of the cooling modules in accordance with a difference between the appertaining first local temperature and a setpoint temperature in such a way that—by setting the pulse length and/or pulse frequency of the cooling fluid jet after the rotation of the furnace shell—the place of the furnace shell where the first local temperature was measured one rotation before then has a first local temperature that is closer to the setpoint temperature than at the time of the preceding measurement, insofar as cooling fluid was applied onto the appertaining impact area during that particular rotation, whereby, however, the difference between the first local temperatures of these two measurements is less than 30K, preferably less than 15K.

Here, the cooling system consists of cooling modules and a cooling system control unit that is connected to the individual modules via one or more data lines, preferably via a data bus, in order to actuate the appertaining on-off valves. In this context, the individual cooling modules are connected via one or more media lines to a source of cooling fluid of the cooling system. The media lines can be configured separately from the individual cooling modules or else they can supply the cooling modules with cooling fluid in parallel via a central media line. For purposes of controlling the pulse length and pulse frequency of the cooling fluid jet, the on-off valves are arranged inside the cooling modules upstream from the appertaining fan nozzle at a suitable position in the appertaining media lines. The individual components of the cooling system such as data or media line(s) as well as the actuatable on-off valves can be suitably selected by the person skilled in the art for the application in question and, in particular, they can be adapted to the requisite throughput rate of the cooling fluid. The on-off valves here can be operated by the cooling system control unit in such a way, for example, that it is possible to switch back and forth between a completely open and a completely closed state, so that the throughput rate of the cooling fluid through the fan nozzle has an idealized rectangular profile. In contrast to the case with continuous fluid jets, in the cooling system according to the invention, a pulsed jet of cooling fluid is used, whereby cooling-fluid pulses alternate with resting phases without cooling fluid between the pulses. This is advantageous, for one thing, in order to obtain a good cooling effect locally, without the cooling off via the furnace shell along a circumference being able to take place too rapidly. Excessively rapid cooling off, for instance, due to a continuous jet of cooling fluid, would cause unacceptable stresses in the material of the furnace shell and would warp or bend the furnace shell, thus rendering the rotary furnace non-operational. However, layer stresses—even though they do not bend the rotary furnace, they do cause the heat-protection materials on the inside of the furnace shell to become detached—can also have very detrimental consequences for the operation of the rotary furnace since the material of the furnace shell can even melt at the places that, without internal protection, are exposed to the processing temperature in the furnace. This also leads to a destruction of the rotary furnace. Such cooling-fluid pulses have a length per pulse and a frequency per pulse per unit of time. In this context, the average throughput rate can be controlled by means of the pulse length as well as by means of the frequency of the pulse (pulse frequency). The cooling fluid cools continuously during one pulse, whereas during the time between the individual pulses, no cooling fluid strikes the furnace shell. It is only the cooling fluid of the next pulse that then cools off the furnace shell further. In this manner, on the one hand, the briefly available maximum cooling output can be set by means of the pulse length, whereas, on the other hand, the time-averaged cooling output is set by means of the pulse frequency relative to the pulse length. By varying these quantities, different places on the furnace shell can be cooled to different extents, so that, at every place of the furnace shell onto which cooling fluid is applied during one rotation of the furnace shell, the desired cooling can be set and controlled individually and as a function of the local temperatures and of the stresses which can be compensated for mechanically by the material of the furnace shell and which result from the cooling. Possible cooling fluids include any fluids that can lower the surface temperature when they strike and evaporate on such a hot surface and whose viscosity is low enough for them to be sprayed through a nozzle. An example of a suitable cooling fluid here is water.

The cooling system control unit employed for control purposes can comprise one or more suitable processors for evaluating the measured data and for calculating the requisite pulse frequencies and pulse lengths as a function of the place and timing of the cooling modules and of the furnace positions at the appertaining circumferences, one or more microcontrollers that serve to actuate the on-off valves, and a suitable storage medium to store the temperature data as a function of the time and the position. The person skilled in the art is capable of selecting the appropriate hardware components for the cooling system control unit. The setpoint temperature here is stored in the cooling system control unit for further control purposes and, if applicable, can be changed by the operator of the rotary furnace. The setpoint temperature here constitutes the desired furnace shell temperature at which mechanical changes in the furnace shell due to heating of the material can be ruled out or are very unlikely during the envisaged period of operation.

In order to achieve a cooling effect by means of evaporation, the cooling fluid has to strike the furnace shell as reproducibly as possible. The person skilled in the art appropriately selects the line pressure at the set distance between the fan nozzle and the furnace shell that is needed for the jet of cooling fluid to strike the intended impact area without being influenced by external influences such as, for example, wind. The fan nozzle can be arranged at a distance from the furnace shell of, for instance, 1 to 1.5 meters. In the case of line pressures of 3 bar to 6 bar in the cooling-fluid lines, the jet of cooling fluid strikes the furnace shell in a manner that can be readily adjusted. In one embodiment, the fan nozzles are oriented essentially perpendicular to the impact area on the furnace shell. In other embodiments, it is also possible to select other orientation angles and thus other angles for the jet of cooling fluid. The term fan nozzles refers to nozzles that widen a jet, at least in one plane, by an opening angle that is dependent on the nozzle.

In one embodiment, the section on the furnace shell that is to be cooled can refer to only the area around the thermal lance, whereas in other embodiments, the furnace shell can also be cooled over its entire length along the axis of rotation of the rotary furnace. In this context, the term furnace shell refers to the outer envelope of the rotating furnace and, as a rule, it is made of temperature-resistant steel, stainless steel or high-temperature-resistant steel. The rotary furnace is cooled by the cooling system only locally in the impact area but the continuous rotation of the rotary furnace and thus of the furnace shell brings about cooling of all of the points along the circumference of the furnace shell that pass through the impact area of the cooling fluid of a given cooling module during a rotation. Typical rotation times are 0.5 to 1.0 minute per rotation. Since the rotational speed of rotary furnaces is kept constant, the specific position of a place on the furnace shell is unambiguously defined by the rotational speed and the specific time (for example, the measuring time of the first temperature, the application time of the cooling fluid, etc.) and thus can be employed as the basis for the position-dependent cooling-system control.

In another embodiment, the momentary rotational speed of the rotary furnace can be measured on the rotary furnace by a microcontroller, for instance, by means of markings on the furnace shell or else by employing rotary encoders as the sensors for the angle of rotation of the furnace shell, which the person skilled in the art appropriately selects, so that the specific position of a place that is to be cooled can be calculated on this basis. The markings or signals of the rotary encoder(s) can be detected, for example, by a control unit of the rotary furnace, and the furnace shell position calculated on this basis can be transmitted to the cooling system control unit. In an alternative embodiment, the markings on the furnace shell or the signals from the rotary encoders are detected by appropriate optical or electronic means of the cooling system that are arranged, for example, on one or more cooling modules or else configured as a rotational-angle detection unit that is separate from the cooling modules and that is connected to the cooling system control unit, and the resultant furnace shell position is transmitted to the cooling system control unit via the data lines.

The heat sensors used for the measurements of the first (and/or second) temperature can comprise any sensors that are suitable for this purpose. For instance, infrared sensors are employed in the cooling system according to the invention. The vapor formed by evaporation of the cooling fluid on the furnace shell influences the temperature measurement only to a slight extent since the selection of the pulse frequency of the jet of cooling fluid allows the generation of the vapor over time to be controlled.

In contrast to the air-cooling systems currently employed, the cooling system according to the invention can be operated at very low noise levels due to the use of a cooling fluid since the application of cooling fluid onto the furnace shell can be carried out virtually noise-free and the evaporation noises are negligible in comparison to the other operational noises of the rotary furnace. Moreover, when water, for example, is used as the cooling fluid, a cooling output of 1 MW of dissipated output is achieved with merely a water quantity of less than 1.8 $m^3$ per hour. Achieving a higher cooling output would call for an appropriate increase in the amount of cooling fluid per unit of time, which could be easily done in view of the small amount necessary for this purpose. In the case of air cooling, more than 30,000 $m^3$ of air would have to be circulated per hour in order to achieve the same cooling output. Therefore, the cooling system according to the invention can be operated in a way that saves resources and energy. Owing to the fact that the amount of cooling fluid applied can be metered easily and precisely by means of quantity profiles that are appropriately adapted to the measured temperatures as a function of time, the stresses that occur in the furnace shell can be kept below values that are critical for the mechanical stability of the furnace shell. For instance, cooling a furnace shell made of steel by 100K relative to its surroundings would lead to a shrinkage of 1 mm per meter of circumference. In the case of circumferences of 15 meters or more, this could lead to a diameter shrinkage of 6 mm. For mechanical reasons, this should be avoided at all costs. However, at a temperature difference of less than 30K, the shrinkage of the circumference would be less than 0.3 mm per meter of circumference. An additional aspect here is that the cooling in the cooling system according to the invention does not take place at the same time over the entire circumference, but rather, along the circumference over the course of one rotation, in other words, it is distributed over 0.5 to 1.0 minutes, which helps to further reduce the layer stresses.

Thanks to the cooling system according to the invention, rotary furnaces can be easily and reliably cooled, whereby the cooling system can be operated at a low noise level, it allows local cooling control and lowers energy consumption.

In one embodiment, the cooling system control unit is connected to and equipped with the on-off valves of various cooling modules in such a way that it actuates the on-off valves of various cooling modules independently of each other in order to set the individual pulse length and/or pulse frequency for each cooling module. As a result, it is not only possible to control the cooling for the specific circumference of the furnace shell as a function of the position in an impact area for a given cooling module, but also, the cooling output of various cooling modules can be adapted, depending on the location of each of the various impact areas, to the conditions and requirements of the rotary furnace. In the area of the thermal lance, for instance, different cooling outputs are needed than in the vicinity of the inlet opening for the raw material that is to be processed in the furnace, where the raw material is at a considerably lower temperature. Consequently, the same cooling system according to the invention can be used individually for different rotary furnaces and operating phases or it can be adapted to changed operating parameters of the furnace.

In one embodiment, the cooling system control unit is configured in such a way that it records the first temperature along one rotation of the furnace shell through the impact area for a circumference of the furnace shell in a position-dependent manner, and said cooling system control unit adapts the pulse length and/or pulse frequency for the appertaining cooling module at least on the basis of the position-dependently recorded first temperatures in such a way that the hottest position on the circumference of the furnace shell is additionally cooled by a stronger cooling by the appertaining cooling module in the neighboring area surrounding the hottest position. In this manner, the cooling system according to the invention can respond to the temperatures measured on the furnace shell not only after the fact, but, depending on the furnace shell position, it can also respond ahead of time on the basis of first temperatures that were recorded over the circumference by providing additional ambient cooling at places that are to be especially cooled.

In one embodiment, after the setpoint temperature for a cooling module has been reached, the cooling system control unit interrupts the cooling by this cooling module until the first local temperature is above the setpoint temperature by at least a selectable value, preferably 30K. If the furnace shell is at or close to the setpoint temperature, then, for cost-related considerations, cooling can be dispensed with for a certain period of time in order to save resources.

In one embodiment, the fan nozzles are configured in such a way that they generate a fan-shaped cooling fluid jet that is at a first opening angle of at least 40° along the axis of rotation of the furnace shell. As a result, a cooling module can spray a larger surface area of the furnace shell with cooling fluid, thereby limiting the number of cooling modules needed for a complete cooling of the section that is to be cooled, and the cooling system consequently can make do with a smaller number of components for a given size of the area that is to be cooled. At the same time, the quantity of cooling fluid is distributed over a wider impact area so that the quantity of cooling fluid per unit of surface area of the furnace shell can be controlled more easily, thus preventing an undesired excessive cooling of a small area of the furnace shell. In this context, through the selection and setting of the fan nozzle, the fanning out of the jet of cooling fluid can be configured in such a way that adjacent impact areas overlap slightly since, as a rule, a smaller quantity of cooling fluid per surface area is applied in the outer regions of the impact area than in the central region of the impact area of each fan nozzle. As a result, adjacent fan nozzles can complement each other in the outer regions of the impact surfaces when it comes to the application of cooling fluid. Even if the impact areas do not overlap, the areas of adjacent cooling modules where a cooling effect is achieved on the furnace shell nevertheless overlap since, thanks to thermal conductivity, the cooling effect extends beyond the pure impact area. Such a jet of cooling fluid that fans out in the plane of the longitudinal direction of the rotary furnace can have a second opening angle of, for example, less than 10° in the direction perpendicular thereto (perpendicular to the axis of rotation of the rotary furnace).

In another embodiment, one or more or else all of the fan nozzles also have a second opening angle in the direction of rotation of the furnace shell (perpendicular to the axis of rotation of the furnace shell) that is at least 30°, preferably at least 60°. In this manner, adjacent areas that are situated along a circumference in the direction of rotation can be cooled so as locally overlap in the same impact area, so that, on the one hand, the cooling output is distributed over a larger surface area, and, on the other hand, it is possible to achieve a pre-cooling of the next areas, which only pass through the impact area subsequently. Owing to the overlapping cooling, the local cooling output is distributed over a longer application time, thus reducing the local stresses in the furnace shell. In a preferred embodiment, the cooling system control unit is provided to establish a short setting for the pulse length of the cooling fluid jet—at the same pulse frequency—when the places of the furnace shell with small differences from the setpoint temperature are passing through the impact area, and to establish a longer setting when the places of the furnace shell with larger differences from the setpoint temperature are passing through the impact area.

In one embodiment, the distance between the adjacent cooling modules and the pressure of the cooling fluid for the cooling modules are set in such a way that the impact areas of the cooling fluids on the furnace shell for adjacent cooling modules touch each other, preferably without overlapping each other. This ensures that the areas to be cooled can be completely cooled using the smallest possible number of cooling modules.

In one embodiment, the cooling module also comprises a second heat sensor in order to measure a second local temperature of the furnace shell in the direction of rotation of the furnace shell behind the impact area and said heat sensor is provided in order to transmit the second local temperature to the cooling system control unit, for which purpose it is connected thereto, whereby the cooling system control unit is configured to actuate the on-off valve of each cooling module in such a way that the difference between the first and second local temperatures during one rotation is less than 10K, preferably less than 5K. The second heat sensor yields a measured value for the local furnace shell temperature directly after this point has passed through the impact area of the cooling fluid. In this manner, the cooling system control unit obtains a direct value for the cooling effect. In contrast, waiting for a complete rotation only yields the value typically after 30 to 60 seconds (time of one furnace shell rotation), as a result of which the comparison between the first temperature during the rotation n and the first temperature one rotation later (rotation n+1) is likewise influenced by the heating of the furnace shell that occurs in the meantime at places that have not been cooled. Owing to the second measured temperature as a supplementary measured value, the furnace shell cooling can be adapted even more precisely to the circumstances in order to avoid detrimental cooling-off effects.

In another embodiment, the first heat sensor in the appertaining cooling module is arranged at a first position, whereby an imaginary connecting line runs between the first position and the nozzle mid-point perpendicular to the axis of rotation of the furnace shell. If there is a second heat sensor as an additional heat sensor in the cooling module, this second heat sensor is arranged at a second position that is not the same as the first position, whereby an imaginary connecting line runs between the first and second positions perpendicular to the axis of rotation of the furnace shell, and the first and second positions are at least at the same distance from the furnace shell. This way, the measured values are acquired by the first and second heat sensors under the same physical conditions, or else the first heat sensor is aimed at the mid-point of the impact area. This mid-point is the point where the largest quantity of cooling fluid is applied onto the impact area during one pulse and consequently, this mid-point requires the greatest level of monitoring. The first and/or second positions of the heat sensors can be selected, for example, in such a way that the cooling fluid that evaporates on the furnace shell does not pass through the area between the heat sensors and the furnace shell, or else only does so to a negligible extent. In this manner, the temperature measurement is no longer influenced by the formation of vapor stemming from the evaporating fluid.

In one embodiment, the pulse length and/or pulse frequency of the cooling fluid jet is set in such a way that the second temperature for the place of the furnace shell where the first temperature had already been detected during the same rotation displays a difference from the setpoint temperature that is smaller by at least 2K than was the case with the first temperature. This ensures not only that stresses in the furnace shell are avoided, but also that sufficient cooling of the furnace shell is nevertheless achieved.

In one embodiment, the cooling system control unit is configured to emit a warning signal as soon as at least the difference between the setpoint temperature and the first temperature is above a threshold value; preferably, the warning signal is transmitted electronically to a rotary furnace control unit. As a result, if the rotary furnace is not being sufficiently cooled, it can be protected by other process settings via the rotary furnace control system. If the warning signal is transmitted automatically and electronically, the rotary furnace control system can respond by the same token automatically and without a time delay. The threshold temperature can likewise be stored and changed in the cooling system control unit. It is dependent on the application in question as well as on the specific rotary furnace.

The invention also relates to a rotary furnace having a cooling system according to the invention. Examples of rotary furnaces are directly heated rotary furnaces used for cement production, for lime calcining, to melt ceramic glass, to melt down metals, for iron reduction, to produce activated carbon as well as for other applications. In one preferred embodiment, the rotary furnace is a cement rotary furnace.

The invention also relates to a method for operating a cooling system according to the invention for rotary furnaces for cooling at least one section of a furnace shell, comprising an arrangement of one or more cooling modules that, for the section of the furnace shell that is to be cooled, are arranged at a distance from the furnace shell, at least along the axis of rotation of the furnace shell, each cooling module having an actuatable on-off valve and a fan nozzle that emits a pulsed fan-shaped cooling fluid jet, and also comprising at least a first heat sensor which serves to measure a first temperature, comprising the following steps:

- measuring the first local temperature of the furnace shell at a place that is in front of the impact area of the cooling fluid as seen in the direction of rotation of the furnace shell;
- transmitting the first local temperature by means of the first heat sensor to a cooling system control unit that is connected thereto;
- setting the pulse length and/or pulse frequency of the cooling fluid jet by means of the cooling system control unit through the actuation of the on-off valve of each of the cooling modules in accordance with a difference between the first temperature and a setpoint temperature so that, after one rotation of the furnace shell, the place of the furnace shell where the first local temperature was measured one rotation before then has a first local temperature that is closer to the setpoint temperature than at the time of the preceding measurement, insofar as cooling fluid was applied onto the appertaining impact area during that particular rotation, whereby, however, the difference between the first local temperatures of these two measurements is less than 30K, preferably less than 15K; and applying the cooling fluid from the outside onto the furnace shell in an impact area of the cooling fluid on the furnace shell, whereby, if there are several cooling modules, the adjacent cooling modules are arranged at a distance relative to each other and parallel to the axis of rotation of the furnace shell in such a way that the impact areas contiguously cool the furnace shell along the axis of rotation, at least in the section that is to be cooled.

In one embodiment of the method, the cooling system control unit actuates the on-off valves of various cooling modules independently of each other in order to set the individual pulse length and/or pulse frequency for each cooling module.

In another embodiment of the method, the cooling system control unit records the first temperatures along one rotation of the furnace shell through the impact area of the cooling fluid jet of the appertaining cooling module for a circumference of the furnace shell in a position-dependent manner, and said cooling system control unit adapts the pulse length and/or pulse frequency for the appertaining cooling module on the basis of the position-dependently recorded temperatures in such a way that the hottest position on the circumference of the furnace shell is additionally cooled by a stronger cooling by the appertaining cooling module in the neighboring area surrounding the hottest position PH.

BRIEF DESCRIPTION OF THE DRAWINGS

These and other aspects of the present invention are presented in detail in the drawings as follows.

DETAILED DESCRIPTION OF EMBODIMENTS

Figure 1:
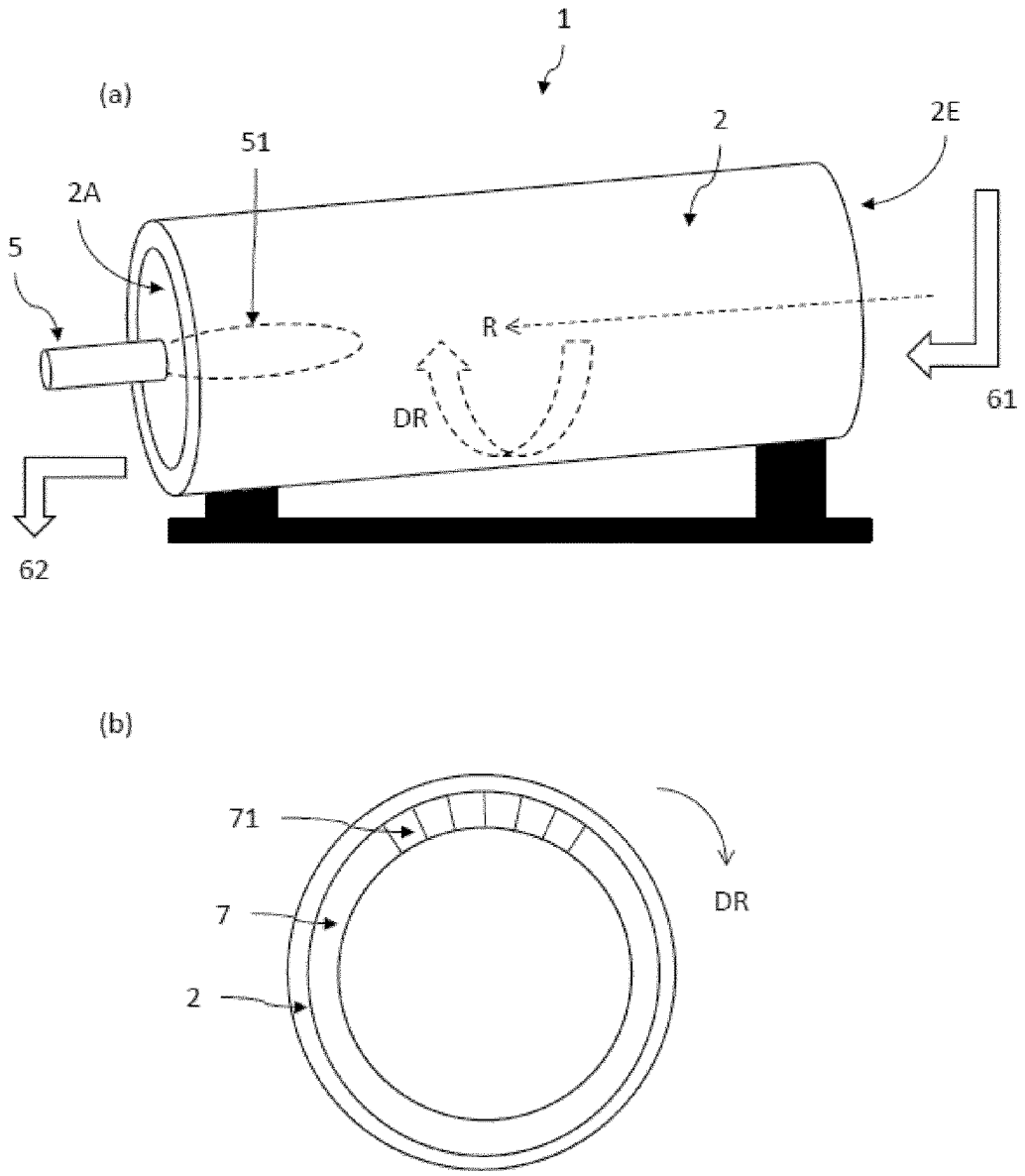
FIG. 1: a schematic depiction of a conventional rotary furnace (a) in a side view and (b) in a sectional view perpendicular to the axis of rotation.

FIG. 1 shows a schematic depiction of a conventional rotary furnace 1 (a) in a side view and (b) in a sectional view perpendicular to the axis of rotation R. Rotary furnaces 1 are employed for continuous processes in process engineering. The rotary furnace 1 shown here comprises a cylindrical rotary tube which is several dozen meters long and that has a furnace shell 2 made of metal and which is rotated in a direction of rotation DR around its longitudinal axis as the axis of rotation R. In this context, the furnace shell 2 is slightly inclined, for instance, by 5°, so that the rotation of the furnace shell 2 causes the material to be transported inside the rotary furnace 1 along the axis of rotation R of the furnace shell 2 from the higher inlet opening (inlet side) 2E to the lower outlet opening (outlet side) 2A. The material 61 that is to be processed, which is fed into the rotary furnace 1 at the inlet opening 2E, can vary and can comprise, for instance, solids, stones, slurries or powders. The requisite processing temperature can be established directly or indirectly in the rotary furnaces 1. When it comes to materials that call for a high processing temperature, the rotary furnace 1 as shown here is heated directly, for example, by a thermal lance 51 generated by a burner 5 situated at the outlet opening 2A of the rotary furnace 1, said lance being located approximately in the middle of the rotary furnace. Directly heated rotary furnaces 1 are used, for example, for cement production, for lime calcining, to melt ceramic glass, to melt down metals, for iron reduction, to produce activated carbon as well as for other applications. In this process, the directly heated rotary furnaces 1 are operated at very high temperatures. During cement production, for example, the raw materials, namely, lime and clay, are ground up and calcined in the rotary furnace 1 at approximately 1450° C. to form so-called clinker, as the material 62 emerging from the outlet opening 2A, and subsequently cooled off and further processed after leaving the rotary furnace 1.

Rotary furnaces 1 that are exposed to such high temperatures have a furnace shell 2 made of stainless steel or of high-temperature steel that can be exposed to temperatures of up to 550° C. or 950° C., respectively. Since the temperatures in the directly heated area are considerably higher, the inside of the furnace shell 2 made of steel is lined with high-temperature ceramic elements 7. In this context, the thickness of the lining 7 determines the temperature to which the steel shell 2 is exposed during the process. In order to prevent the furnace shell 2 from warping during operation due to the temperature load or in order to prevent damage to the inner lining that would cause the furnace shell 2 to bend or even melt, the furnace shell is cooled from the outside (not shown explicitly here). As a rule, the high-temperature ceramic elements 7 consist of ceramic tiles 71 that are arranged next to each other so as to be in contact with each other.

Figure 2:
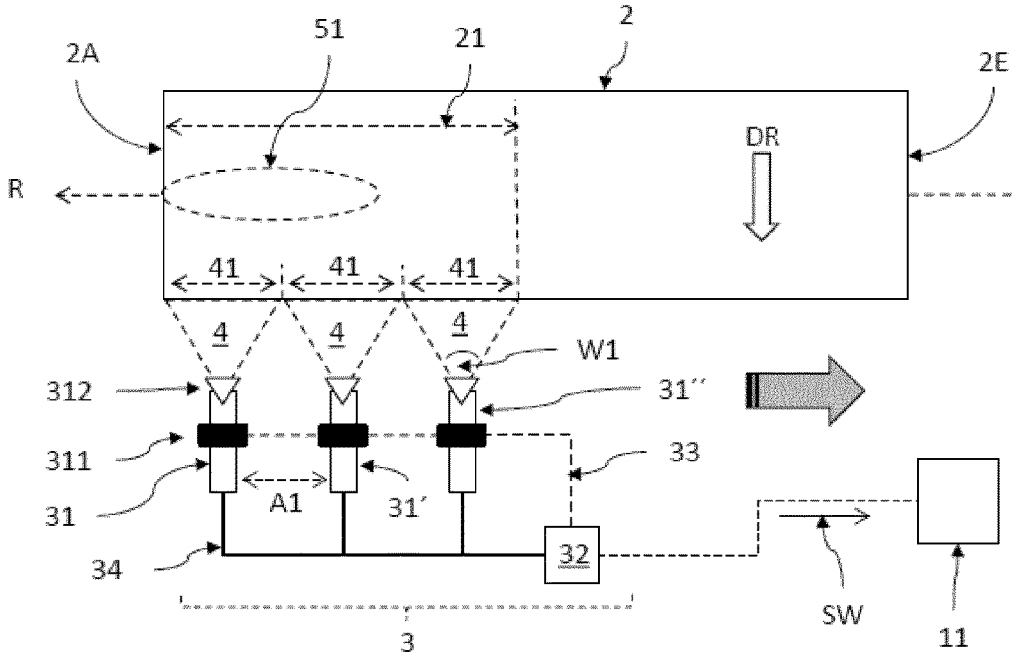
FIG. 2: a rotary furnace with an embodiment of the cooling system according to the invention, in a top view from above.

FIG. 2 shows a rotary furnace 1 with an embodiment of the cooling system 3 according to the invention, in a top view from above. In this embodiment, by way of example, the cooling system 3 for rotary furnaces 1 for cooling at least one section 21 of a furnace shell 21 comprises an arrangement of three cooling modules 31, 31', 31" for applying cooling fluid 4 from the outside onto the furnace shell 2 in an impact area 41 of the cooling fluid 4 on the furnace shell 2, whereby the cooling modules 31 in the section 21 of the furnace shell 2 that is to be cooled are arranged at least along the axis of rotation R of the furnace shell 2. The gray arrow here indicates that, aside from the cooling modules 31, 31', 31" shown here, in other embodiments, other cooling modules can also be arranged over the entire length of the rotary furnace 1 or of the furnace shell 2. Each cooling module 31, 31', 31" has an actuatable on-off valve 311 and a fan nozzle 312 by means of which a pulsed fan-shaped cooling fluid jet 4 is sprayed onto the furnace shell. For this purpose, adjacent cooling modules 31, 31', 31" are at a distance A1 relative to each other and parallel to the axis of rotation of the furnace shell R, said distance having been suitably selected as a function of the widening of the cooling-fluid jet by the fan nozzle 312, so that the impact areas 41 contiguously cool the furnace shell 2 along its axis of rotation R, at least in the section 21 that is to be cooled. For this purpose, each cooling module 31 comprises at least a first heat sensor 313 (see FIG. 3) which is connected to a cooling system control unit 32 via data lines 33, which serves to measure a first local temperature T1 of the furnace shell 2 at a place that is in front of the impact area 41 of the cooling fluid 4 as seen in the direction of rotation DR of the furnace shell 2, and which serves to transmit U1 the first local temperature T1 to the cooling system control unit 32 via the data lines 33. The cooling system control unit 32 is configured to actuate the on-off valve 311 of each of the cooling modules 31 via the data line 33 in accordance with a difference DT1 between the appertaining first local temperature T1 and a setpoint temperature ST in such a way that—by setting E the pulse length and/or pulse frequency of the cooling fluid jet 4 after one rotation n+1 of the furnace shell 2—the place S1 of the furnace shell 2 where the first local temperature T1 was measured one rotation before (rotation n) then has a first local temperature T1' that is closer to the setpoint temperature ST than at the time of the preceding measurement, whereby, however, the difference DT1-U between the first local temperatures T1, T1' of these two measurements is less than 30K, preferably less than 15K. Regarding the features not explicitly mentioned here, reference is hereby made to FIGS. 3 and 4. The fan nozzles 312 are configured in such a way that they generate a fan-shaped cooling fluid jet 4 that has a first opening angle W1 of at least 40° along the axis of rotation R of the furnace shell 2. Therefore, in this embodiment, the cooling system control unit 32 is connected to the on-off valves 311 of various cooling modules 31, 31', 31" and configured in such a way that the cooling system control unit 32 actuates the on-off valves 311 of various cooling modules 31, 31', 31" independently of each other in order to set an individual pulse length and/or pulse frequency for each cooling module 31, 31', 31". In this context, the distance A1 between the adjacent cooling modules 31, 31', 31" is selected in such a way and the pressure of the cooling fluid 4 for the cooling modules 31, 31', 31" is set in such a way that the impact areas 41 of the cooling fluids 4 on the furnace shell 2 for adjacent cooling modules 31, 31', 31" touch, preferably without overlapping each other in this process. The distance of the fan nozzle to the furnace shell 2 can be suitably set as a function of the temperature of the furnace shell 2, of the line pressure used for the cooling fluid and of the first and/or second opening angles. Typical line pressures for the cooling fluid are, for instance, 3 bar to 6 bar.

In this embodiment, the cooling system 3 and the cooling system control unit 32 are configured to emit a warning signal SW as soon as at least the difference DT1 between the setpoint temperature ST and the first temperature T1 is above a threshold value. For this purpose, the cooling system control unit 32 is electronically connected to the rotary furnace control unit 11 by means of a data line indicated by a broken line, so that the warning signal SW can be automatically transmitted to the rotary furnace control unit 11.

Figure 3:
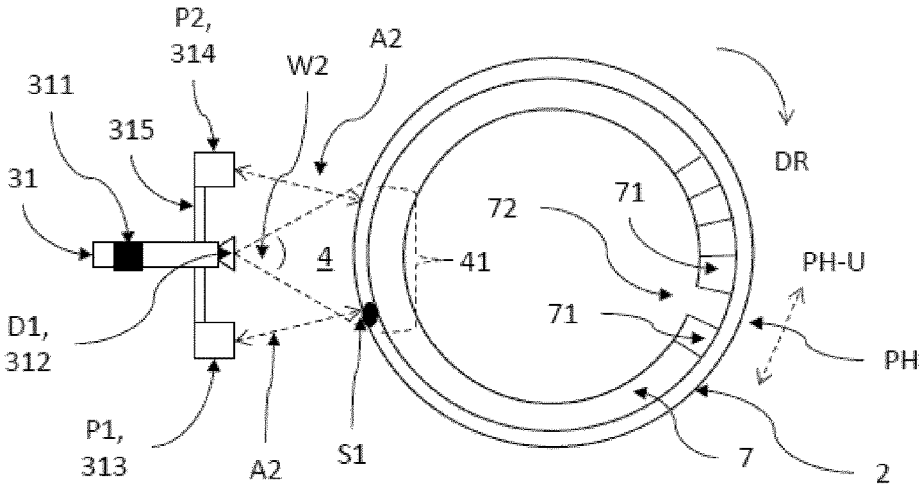
FIG. 3: a rotary furnace with another embodiment of the cooling system according to the invention, in a sectional view perpendicular to the axis of rotation.

FIG. 3 shows a rotary furnace 1 with another embodiment of the cooling system 3 according to the invention, in a sectional view perpendicular to the axis of rotation of the rotary furnace 1. In this context, the figure description is based essentially on the components of the cooling system 3 according to the invention that are not shown in FIG. 2. When it comes to the components mentioned here that are not depicted in FIG. 3, reference is made to FIG. 2. Aside from the first heat sensor 313 that is located at position P1 and that serves to measure the first local temperature T1 at the place S1 on the furnace shell 2 before the place S1 reaches the impact area of the cooling fluid on the furnace shell 2 owing to the rotation of the furnace shell 2 in the direction of rotation DR, the cooling module 31 also comprises a second heat sensor 314 that serves to measure a second local temperature T2 of the furnace shell 2 in the direction of rotation DR of the furnace shell 2 behind the impact area 41, which is indicated by the broken-line curved brackets. Both heat sensors 313, 314 are connected to the cooling system control unit 32, as shown in FIG. 2, in order to transmit U1, U2 the first and second local temperatures T1, T2, whereby the cooling system control unit 32 is provided for purposes of actuating the on-off valve 311 of each cooling module—here the depicted cooling module 31—in such a way that the difference DT2 between the first and second local temperatures T1, T2 during one rotation is less than 10K, preferably less than 5K. Here, however, the cooling system control unit sets the pulse length and/or the pulse frequency of the cooling-fluid jet 4 in such a way that the second temperature T2 for the place ST of the furnace shell 2 where the first temperature T1 was already detected during the same rotation displays a difference of at least 0.5K less relative to the setpoint temperature ST than the first temperature T1 did. The first heat sensor 313 here is arranged at a first position P1 whereby an imaginary connecting line between the first position P1 and the mid-point D1 of the nozzle runs perpendicular to the axis of rotation R of the furnace shell 2. The second heat sensor 314 is arranged at a second position at a distance from the first position, behind the impact area of the cooling fluid on the furnace shell 2 as seen in the direction of rotation of the furnace shell 2, whereby an imaginary connecting line between the first position and second positions P1,P2 runs perpendicular to the axis of rotation R of the furnace shell 2, and the first and second positions P1, P2 are at least at the same distance A2 to the furnace shell. Moreover, P1 and P2 can be selected in such a way that the temperature measurements are not influenced by the evaporating cooling fluid 4, for instance, by means of the shape and length of the fastening means 315 of the heat sensors 313, 314 on the cooling module 32.

The fan nozzle 312 shown here allows the cooling-fluid jet 4 to have, in addition to the first opening angle, a second opening angle W2 in the direction of rotation DR of the furnace shell 2 amounting to at least 30°, preferably at least 60°. Preferably, the cooling system control unit 32 here is provided to establish a short setting for the pulse length of the cooling fluid jet 4—at the same pulse frequency—when the places of the furnace shell 2 with small differences DT1 from the setpoint temperature ST are passing through the impact area 41, and to establish a longer setting when the places of the furnace shell 2 with larger differences DT1 from the setpoint temperature ST are passing through the impact area 41.

In this embodiment, by way of an example for problem scenarios that might occur, the heat-insulation layer 7, made of ceramic tiles 71, is shown on the inside of the furnace shell 2, whereby such a ceramic tile 71 is missing at the place 72, so that this place 72 is exposed without having any protection to the temperature that prevails inside the rotary furnace. Consequently, the outside of the furnace shell 2 at the place PH will become considerably hotter than at the places where the protective ceramic tiles 71 are still present on the inside. In order to nevertheless be able to sufficiently cool the hot place PH, in this embodiment, the cooling system control unit 32 is configured in such a way that it records the first local temperature T1 along one rotation 2Un+1 of the furnace shell through the impact area 41 for a circumference of the furnace shell 2 in a position-dependent manner, and said cooling system control unit 32 adapts the pulse length and/or pulse frequency for the appertaining cooling module 31 at least on the basis of the position-dependently recorded first temperatures T1 in such a way that the hottest position PH on the circumference of the furnace shell 2 is additionally cooled by a stronger cooling by the appertaining cooling module 31 in the neighboring area PH-U surrounding the hottest position PH. The neighboring area PH-U is indicated here by the broken-line arrow running along the direction of rotation. Naturally, the neighboring area PH-U also extends in the direction along the axis of rotation, which is not shown here.

Figure 4:
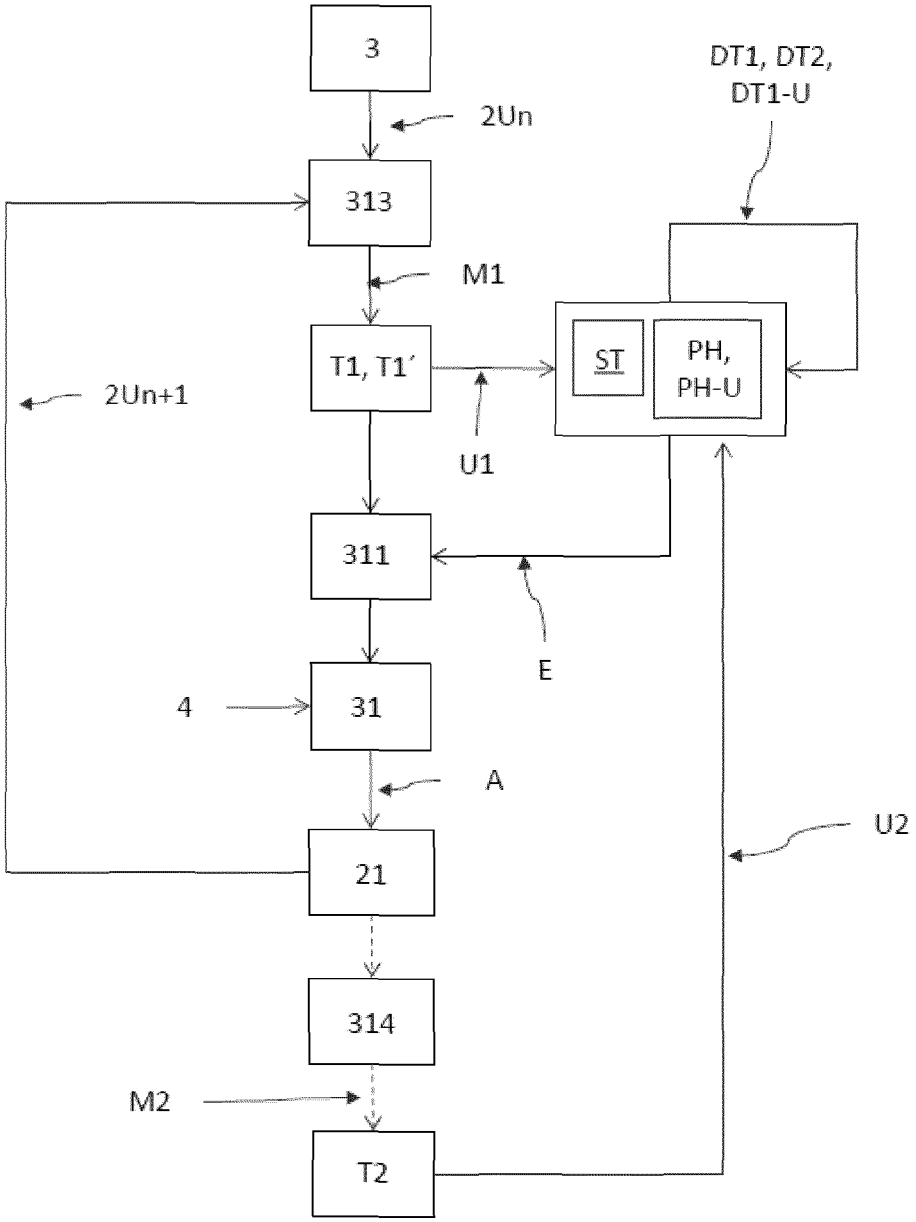
FIG. 4: an embodiment of the method according to the invention, for operating the cooling system according to the invention.

FIG. 4 shows an embodiment of the method according to the invention, for operating the cooling system 3 according to the invention, whereby initially the first local temperature T1 of the furnace shell 2 is measured M1 in the direction of rotation DR of the furnace shell 2 as seen in front of the impact area 41 of the cooling fluid 4. Subsequently, the first local temperature T1 is transmitted U1 by the first heat sensor 313 to the cooling system control unit 32 that is connected to it and then stored there. The setpoint temperature ST is stored in the cooling system control unit 32. The difference DT1 between the first temperature T1 and the setpoint temperature ST is measured on the basis of the measured first local temperature T1. If the first local temperatures for all points on the circumference of the furnace shell for at least one rotation of the furnace shell 2 are already available, the difference DT1-U of the first temperatures T1, T1' between the current measurement M1 and the preceding measurement during the preceding rotation is also calculated for the same places S1 on the furnace shell 2. If the cooling module 31 comprises a second heat sensor 314, the difference DT2 between the first temperature T1 and the second temperature T2, which have been measured M2 by the second heat sensor 314 and transmitted U2 to the cooling system control unit 32, is also calculated. On the basis of the calculated differences DT1, DT2 and/or DT1-U, the cooling system control unit 32 sets E the pulse length and/or pulse frequency of the cooling-fluid jet 4 by actuating the on-off valve 311 of each of the modules 31, 31', 31" in accordance with a difference DT1, so that, after one rotation 2Un+1 of the furnace shell 2, the place S1 of the furnace shell 2 where the first local temperature T1 was measured one rotation before then exhibits a first local temperature T1' that is closer to the setpoint temperature ST than in the preceding measurement, whereby the difference DT1-U between the first local temperatures T1, T1' of these two measurements, however, is less than 30K, preferably less than 15K. Depending on the embodiment of the cooling system control unit 32 and on the components present, such as the second heat sensor 314, the differences DT2 and a minimum value for the furnace shell cooling are also taken into consideration for purposes of controlling the cooling process. Once the on-off valve 311 has been actuated in accordance with the evaluation of the temperature measurements, the on-off valve 311 and the fan nozzle 312 are employed to apply A the cooling fluid 4 from the outside onto the furnace shell 2 in an impact area 41 of the cooling fluid 4 onto the furnace shell 2, whereby adjacent cooling modules 31, 31', 31" are arranged at a distance A1 relative to each other and parallel to the axis of rotation R of the furnace shell 2 in such a way that the impact areas 41 contiguously cool the furnace shell 2 along the axis of rotation R, at least in the section 21 that is to be cooled. In this process, the cooling system control unit 32 in this embodiment controls the on-off valves 311 of various cooling modules 31, 31', 31" independently of each other in order to set E individual pulse lengths and/or pulse frequencies for each cooling module 31, 31', 31".

In this embodiment, the cooling system control unit 32 records the first temperatures T1 along one rotation of the furnace shell through the impact area 41 of the cooling fluid jet 4 of the appertaining cooling module 31, 31', 31" for a circumference of the furnace shell 2 in a position-dependent manner, as a result of which the cooling system control unit 32 identifies the hottest position PH on the furnace shell (if applicable several hot positions PH on the furnace shell) on the basis of the data and then adapts the pulse length and/or pulse frequency for the appertaining cooling module 31, 31', 31" through whose impact area 41 the hottest place PH or the hottest places PH pass, on the basis of these position-dependently recorded temperatures T1 in such a way that the hottest position PH on the circumference of the furnace shell 2 is additionally cooled by a stronger cooling by the appertaining cooling module 31, 31', 31" in the neighboring area PH-U surrounding the hottest position PH.

In another embodiment, after the setpoint temperature ST for a cooling module 31, 31', 31" has been reached, the cooling system control unit 32 interrupts the cooling by this cooling module 31, 31', 31" until the first local temperature T1 is above the setpoint temperature ST by at least a selectable value (switch-on threshold), preferably 30K. For instance, the setpoint temperature in a cement rotary furnace is 210° C., so that the switch-on threshold for a renewed cooling procedure would then be 240° C.

The embodiments shown here constitute merely examples of the present invention and consequently should not be construed in a limiting manner. Alternative embodiments that might be considered by the person skilled in the art are likewise encompassed by the scope of protection of the present invention.

LIST OF REFERENCE NUMERALS

1 rotary furnace
11 rotary furnace control unit
2 furnace shell
2E inlet opening for the material that is to be processed
2A outlet opening for the processed material
2Un furnace shell after n rotations (before one rotation)
2Un+1 furnace shell after n+1 rotations (before one additional rotation)
21 section of the furnace shell that is to be cooled
3 cooling system according to the invention
31, 31', 31" cooling module
311 on-off valve in the cooling module
312 fan nozzle in the cooling module
313 first heat sensor
314 second heat sensor
315 fastening means for heat sensor(s) on the cooling module
32 cooling system control unit
33 data lines in the cooling system
34 cooling-fluid lines in the cooling system
4 cooling fluid, cooling-fluid jet
41 impact area of the cooling fluid on the furnace shell
5 burner of the rotary furnace
51 thermal lance
61 material that is to be processed by the rotary furnace
62 material be processed by the rotary furnace
7 heat-insulation layer on the inside of the furnace shell
71 ceramic tiles
72 ceramic tile missing in the heat-insulation layer A application of cooling fluid from the outside onto the furnace shell A1 distance of adjacent cooling modules relative to each other and parallel to the axis of rotation R A2 distance between the furnace shell and the first and/or second positions of the first and/or second heat sensors D1 mid-point of the nozzle DR direction of rotation of the furnace shell DT1 difference between the first temperature and the setpoint temperature DT2 difference between the first temperature and the second temperature during the same rotation of the furnace shell DT1-U difference between two first temperatures of the same places on the furnace shell after one rotation of the furnace shell E setting the pulse frequency and the pulse length of the cooling-fluid jet M1 measuring the first local temperature M2 measuring the second local temperature P1 position where the first heat sensor is located P2 position where the second heat sensor is located PH hottest position on the circumference of the furnace shell for a given impact area PH-U surroundings of the hottest position R axis of rotation of the furnace shell S1 place on the furnace shell where the first local temperature is measured ST setpoint temperature of the furnace shell SW warning signal emitted by the cooling system T1, T1' first temperature T2 second temperature U1 transmission of the first temperature to the cooling system control unit U2 transmission of the second temperature to the cooling system control unit W1 first opening angle of the cooling-fluid jet W2 second opening angle of the cooling-fluid jet

The invention claimed is:

1. A cooling system for rotary furnaces for cooling at least one section of a furnace shell, comprising an arrangement of one or more cooling modules for applying (A) cooling fluid from the outside onto the furnace shell in an impact area of the cooling fluid on the furnace shell, whereby the cooling modules for the section of the furnace shell that is to be cooled are arranged at a distance from the furnace shell, at least along the axis of rotation (R) of the furnace shell, each cooling module having an actuatable on-off valve and a fan nozzle that emits a pulsed fan-shaped cooling fluid jet and, if there are several cooling modules, the adjacent cooling modules are arranged at a distance (A1) relative to each other and parallel to the axis of rotation (R) of the furnace shell in such a way that the impact areas contiguously cool the furnace shell along its axis of rotation (R), at least in the section that is to be cooled, and whereby each cooling module comprises at least a first heat sensor which is connected to a cooling system control unit and which serves to measure a first local temperature (T1) of the furnace shell at a place that is in front of the impact area of the cooling fluid as seen in the direction of rotation (DR) of the furnace shell and which it serves to transmit (U1) the first local temperature (T1) to the cooling system control unit, and the cooling system control unit is configured to actuate the on-off valve of each of the cooling modules in accordance with a difference (DT1) between the appertaining first local temperature (T1) and a setpoint temperature (ST) in such a way that—by setting (E) the pulse length and/or pulse frequency of the cooling fluid jet after one rotation (2Un+1) of the furnace shell—the place (S1) of the furnace shell where the first local temperature (T1) was measured one rotation (2Un) before then has a first local temperature (T1') that is closer to the setpoint temperature (ST) than at the time of the preceding measurement, insofar as cooling fluid was applied onto the appertaining impact area during that particular rotation, whereby, however, the difference (DT1-U) between the first local temperatures (T1, T1') of these two measurements is less than 30K, preferably less than 15K.

2. The cooling system according to claim 1,
characterized in that
the cooling system control unit is connected to and equipped with the on-off valves of various cooling modules in such a way that it actuates the on-off valves of various cooling modules independently of each other in order to set the individual pulse length and/or pulse frequency for each cooling module.

3. The cooling system according to claim 2,
characterized in that
the cooling system control unit is configured in such a way that it records the first temperature (T1) along one rotation (2Un+1) of the furnace shell through the impact area for a circumference of the furnace shell in a position-dependent manner, and said cooling system control unit adapts the pulse length and/or pulse frequency for the appertaining cooling module at least on the basis of the position-dependently recorded first temperatures (T1) in such a way that the hottest position (PH) on the circumference of the furnace shell is additionally cooled by a stronger cooling by the appertaining cooling module in the neighboring area (PH-U) surrounding the hottest position (PH).

4. The cooling system according to claim 2,
characterized in that,
after the setpoint temperature (ST) for a cooling module has been reached, the cooling system control unit interrupts the cooling by this cooling module until the first local temperature (T1) is above the setpoint temperature (ST) by at least a selectable value, preferably 30K.

5. The cooling system according to claim 1,
characterized in that
the fan nozzles are configured in such a way that they generate a fan-shaped cooling fluid jet that is at a first opening angle (W1) of at least 40° along the axis of rotation (R) of the furnace shell.

6. The cooling system according to claim 5,
characterized in that
the fan nozzles also have a second opening angle (W2) in the direction of rotation (DR) of the furnace shell that is at least 30°, preferably at least 60°, and in this context, the cooling system control unit is preferably provided to establish a short setting for the pulse length of the cooling fluid jet (4)—at the same pulse frequency—when the places of the furnace shell with small differences (DT1) from the setpoint temperature (ST) are passing through the impact area, and to establish a longer setting when the places of the furnace shell with larger differences (DT1) from the setpoint temperature (ST) are passing through the impact area.

7. The cooling system according to claim 1,
characterized in that
the distance (A1) between the adjacent cooling modules and the pressure of the cooling fluid for the cooling modules are set in such a way that the impact areas of the cooling fluids on the furnace shell for adjacent cooling modules touch each other, preferably without overlapping over each other.

8. The cooling system according to claim 1, characterized in that the cooling module also comprises a second heat sensor in order to measure a second local temperature (T2) of the furnace shell in the direction of rotation (DR) of the furnace shell behind the impact area and said heat sensor is provided in order to transmit (U2) the second local temperature (T2) to the cooling system control unit, for which purpose it is connected thereto, whereby the cooling system control unit is configured to actuate the on-off valve of each cooling module in such a way that the difference (DT2) between the first and second local temperatures (T1, T2) during one rotation is less than 10K, preferably less than 5K.

9. The cooling system according to claim 1, characterized in that the first heat sensor in the appertaining cooling module is arranged at a first position (P1), whereby an imaginary connecting line runs between the first position (P1) and the nozzle mid-point (D1) perpendicular to the axis of rotation (R) of the furnace shell and, if there is a second heat sensor as an additional heat sensor in the cooling module, this second heat sensor is arranged at a second position (P2) that is not the same as the first position (P1), whereby an imaginary connecting line runs between the first and second positions (P1, P2) perpendicular to the axis of rotation (R) of the furnace shell, and the first and second positions (P1, P2) are at least at the same distance (A2) from the furnace shell.

10. The cooling system according to claim 8, characterized in that the pulse length and/or pulse frequency of the cooling fluid jet is set in such a way that the second temperature (T2) for the place (S1) of the furnace shell where the first temperature (T1) had already been detected during the same rotation displays a difference from the setpoint temperature (ST) that is smaller by at least 0.5K than was the case with the first temperature (T1).

11. The cooling system according to claim 1, characterized in that the cooling system control unit is configured to emit a warning signal (SW) as soon as at least the difference (DT1) between the setpoint temperature (ST) and the first temperature (T1) is above a threshold value; preferably the warning signal (SW) is transmitted electronically to a rotary furnace control unit.

12. A rotary furnace, preferably a rotary cement furnace, having a cooling system according to claim 1.

13. A method for operating a cooling system for rotary furnaces according to claim 1 for cooling at least one section of a furnace shell comprising an arrangement of one or more cooling modules that, for the section of the furnace shell that is to be cooled, are arranged at a distance from the furnace shell, at least along the axis of rotation (R) of the furnace shell, each cooling module having an actuatable on-off valve and a fan nozzle that emits a pulsed fan-shaped cooling fluid jet, and also comprising at least a first heat sensor which serves to measure a first temperature (T1), comprising the following steps:

measuring (M1) the first local temperature (T1) of the furnace shell at a place that is in front of the impact area of the cooling fluid as seen in the direction of rotation (DR) of the furnace shell;

transmitting (U1) the first local temperature (T1) by means of the first heat sensor to a cooling system control unit that is connected thereto;

setting (E) the pulse length and/or pulse frequency of the cooling fluid jet by means of the cooling system control unit through the actuation of the on-off valve of each of the cooling modules in accordance with a difference (DT1) between the first temperature (T1) and a setpoint temperature (ST) so that, after one rotation (2Un+1) of the furnace shell, the place (S1) of the furnace shell where the first local temperature (T1) was measured one rotation (2Un) before then has a first local temperature (T1') that is closer to the setpoint temperature (ST) than at the time of the preceding measurement, insofar as cooling fluid was applied onto the appertaining impact area during that particular rotation, whereby, however, the difference (DT1-U) between the first local temperatures (T1, T1') of these two measurements is less than 30K, preferably less than 15K; and applying (A) the cooling fluid from the outside onto the furnace shell in an impact area of the cooling fluid on the furnace shell, whereby, if there are several cooling modules, the adjacent cooling modules are arranged at a distance (A1) relative to each other and parallel to the axis of rotation (R) of the furnace shell in such a way that the impact areas contiguously cool the furnace shell along the axis of rotation (R), at least in the section that is to be cooled.

14. The method according to claim 13, whereby the cooling system control unit actuates the on-off valves of various cooling modules independently of each other in order to set (E) the individual pulse length and/or pulse frequency for each cooling module.

15. The method according to claim 14, whereby the cooling system control unit records the first temperatures (T1) along one rotation of the furnace shell through the impact area of the cooling fluid jet of the appertaining cooling module for a circumference of the furnace shell in a position-dependent manner, and said cooling system control unit adapts the pulse length and/or pulse frequency for the appertaining cooling module on the basis of the position-dependently recorded temperatures (T1) in such a way that the hottest position (PH) on the circumference of the furnace shell is additionally cooled by a stronger cooling by the appertaining cooling module in the neighboring area (PH-U) surrounding the hottest position (PH).

* * * * *